US007806735B1

(12) United States Patent
Chen et al.

(10) Patent No.: US 7,806,735 B1
(45) Date of Patent: Oct. 5, 2010

(54) CROSSTALK-FREE CONNECTOR

(75) Inventors: Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/462,370

(22) Filed: Aug. 3, 2009

(30) Foreign Application Priority Data

Apr. 22, 2009 (TW) ..... 98113280 A

(51) Int. Cl.
*H01R 24/00* (2006.01)

(52) U.S. Cl. ..... 439/676; 439/79

(58) Field of Classification Search ..... 439/79, 439/541.5, 676, 607.01, 607.07, 607.09, 439/607.1, 607.11, 607.26
See application file for complete search history.

(56) References Cited

U.S. PATENT DOCUMENTS 6,113,428 A * 9/2000 Yeh ..... 439/607.17
6,139,367 A * 10/2000 Yeh ..... 439/607.17
6,863,549 B2 * 3/2005 Brunker et al. ..... 439/108
7,445,505 B1 * 11/2008 Yi ..... 439/607.01
7,473,136 B2 * 1/2009 Hu et al. ..... 439/607.01

* cited by examiner

*Primary Examiner*—Thanh-Tam T Le
(74) *Attorney, Agent, or Firm*—William E. Pelton, Esq.; Cooper & Dunham LLP

(57) ABSTRACT

A crosstalk-eliminating connector has an insulative body, multiple terminals and a metal shell. The terminals are mounted in the insulative body and some of the terminals are pairs of signal transmission terminals. The metal shell has at least one crosstalk-eliminating slot and each crosstalk-eliminating slot is located between two adjacent pairs of the signal transmission terminals when observed from the rear end of the insulative body. The at least one crosstalk-eliminating slot efficiently eliminates the crosstalk between adjacent pairs of the signal transmission terminals.

8 Claims, 9 Drawing Sheets

CROSSTALK-FREE CONNECTOR

BACKGROUND OF THE INVENTION

1. Field of the Invention

The present invention relates to a connector, and more particularly to a crosstalk-free connector that has two pairs of signal transmission terminals and a metal shell including a crosstalk-eliminating slot between the pairs to prevent the crosstalk between the pairs of the signal transmission terminals.

2. Description of Related Art

Conventional electronic devices have connectors implementing data transmission between electronic devices. The most popular connectors are Universal Serial Bus (USB) 2.0 connectors.

Because the electronic devices develop fast and data transmission speed thereof are increased continuously, new data transmission protocols of connectors must be designed to meet the requirement of the electronic devices.

The USB 2.0 protocol only provides a pair of signal transmission terminals, which is insufficient to the latest electronic devices. Therefore, USB implementers Forum (USB IF) sets for the USB 3.0 protocol that provides two pairs of signal transmission terminals for increased data flow. However, returns currents of the terminal pairs have crosstalk to interfere with each other so that the signal transmission is unstable and even fails.

To overcome the shortcomings, the present invention provides a crosstalk-free connector to mitigate or obviate the aforementioned problems.

SUMMARY OF THE INVENTION

The main objective of the invention is to provide a crosstalk-free connector that has two pairs of signal transmission terminals and a metal shell including a crosstalk-eliminating slot between the pairs to prevent the crosstalk between the pairs of the signal transmission terminals.

A crosstalk-eliminating connector in accordance with the present invention has an insulative body, multiple terminals and a metal shell. The terminals are mounted in the insulative body and some of the terminals are pairs of signal transmission terminals. The metal shell has at least one crosstalk-eliminating slot and each crosstalk-eliminating slot is located between two adjacent pairs of the signal transmission terminals when observed from the rear end of the insulative body. The at least one crosstalk-eliminating slot efficiently eliminates the crosstalk between adjacent pairs of the signal transmission terminals.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 5, a crosstalk-free connector in accordance with the present invention may be but not limited to a USB 3.0 receptacle connector, and comprises an insulative body (10), multiple terminals and a metal shell (40) and may further have a positioning bracket (50).

Figure 7:
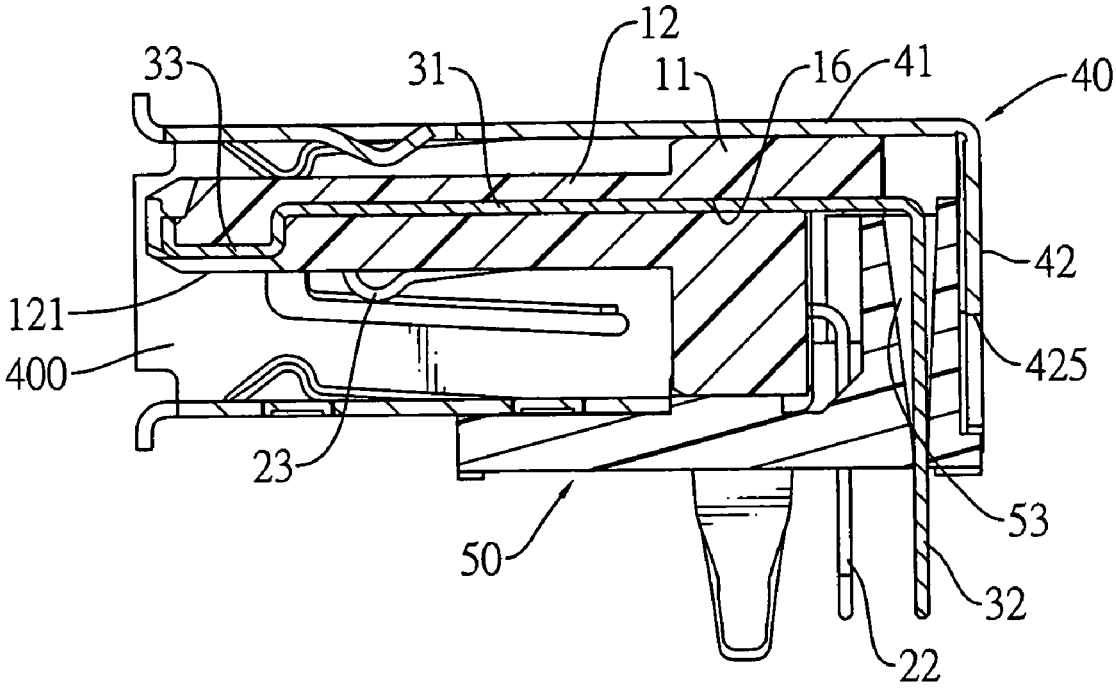
FIG. 7 is a cross sectional side view of the crosstalk-free connector in FIG. 1.
Figure 8:
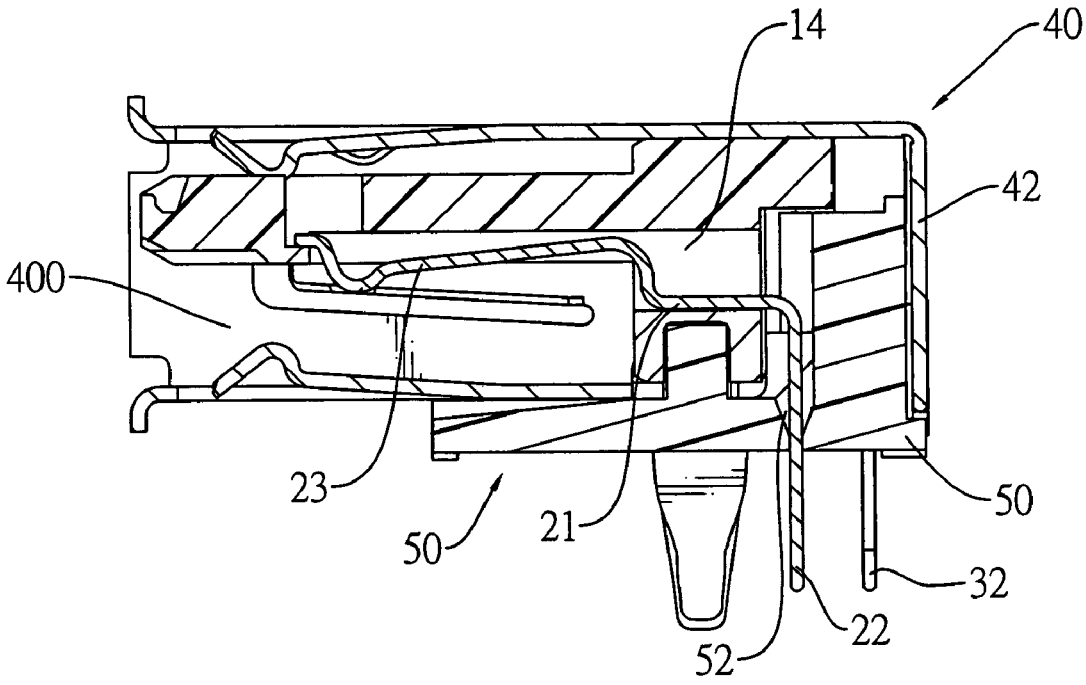
FIG. 8 is another cross sectional side view of the crosstalk-free connector in FIG. 1.

With further reference to FIGS. 7 and 8, the insulative body (10) has a front end, a rear end, a base (11), a tongue (12), multiple first terminal holes (14) and multiple second terminal holes (16).

The tongue (12) is formed on and protrudes forwards from the base (11) and has a top and a bottom.

The first terminal holes (14) are defined through the base (11).

The second terminal holes (16) are defined through the base (11) and the tongue (12).

The terminals are mounted in the insulative body (10). Some of the terminals are multiple pairs of signal transmission terminals (30*a*, 30*b*) and remains of the terminals may be grounding terminals. Each terminal has a mounting section (21, 31), a soldering section (22, 32) and a contacting section (23, 33).

The mounting section (21, 31) is mounted in one of the first and second terminal holes (14, 16) of the insulative body (10).

The soldering section (22, 32) is formed on and protrudes downwards from the mounting section (21, 31) behind the rear end of the insulative body (10) and may be soldered on a printed circuit board.

The contacting section (23, 33) is formed on and protrudes forwards from the mounting section (22, 32), is mounted on the bottom of the tongue (12) and is exposed out of the insulative body (10).

In a preferred embodiment, the terminals are classified into but not limited to multiple USB 2.0 terminals (20) and multiple USB 3.0 terminals (30, 30*a*, 30*b*).

The USB 2.0 terminals (20) are arranged in a transverse row relative to the insulative body (10), may be four and are mounted respectively through the first terminal holes (14).

The USB 3.0 terminals (30, 30*a*, 30*b*) are arranged in a transverse row relative to the insulative body (10), may be five and are mounted respectively through the second terminal holes (16). The five USB 3.0 terminals (30, 30*a*, 30*b*) may be a pair of first signal transmission terminals (30*a*), a pair of second signal transmission terminals (30*b*) and a grounding terminal (30). The first signal transmission terminals (30*a*) are respectively held by the first terminal holes (14) and may be a positive super-speed transmitter differential terminal and a negative super-speed transmitter differential terminal. The second signal transmission terminals (30*b*) are respectively held by the second terminal holes (16) and may be a positive super-speed receiver differential terminal and a negative super-speed receiver differential terminal. The grounding terminal (30) is located between the pair of the first signal transmission terminals (30*a*) and the pair of the second signal transmission terminals (30*b*).

The metal shell (40) is metal, covers the insulative body (10) and the terminals and has a front opening, a cavity (400), a top plate (41), a rear plate (42), two opposite side plates (43) and a bottom plate (44).

The cavity (400) is defined in the metal shell (40), communicates with the front opening, accommodates the insulative body (10) and the terminals and may be a socket to hold a corresponding plug connector.

Figure 1:
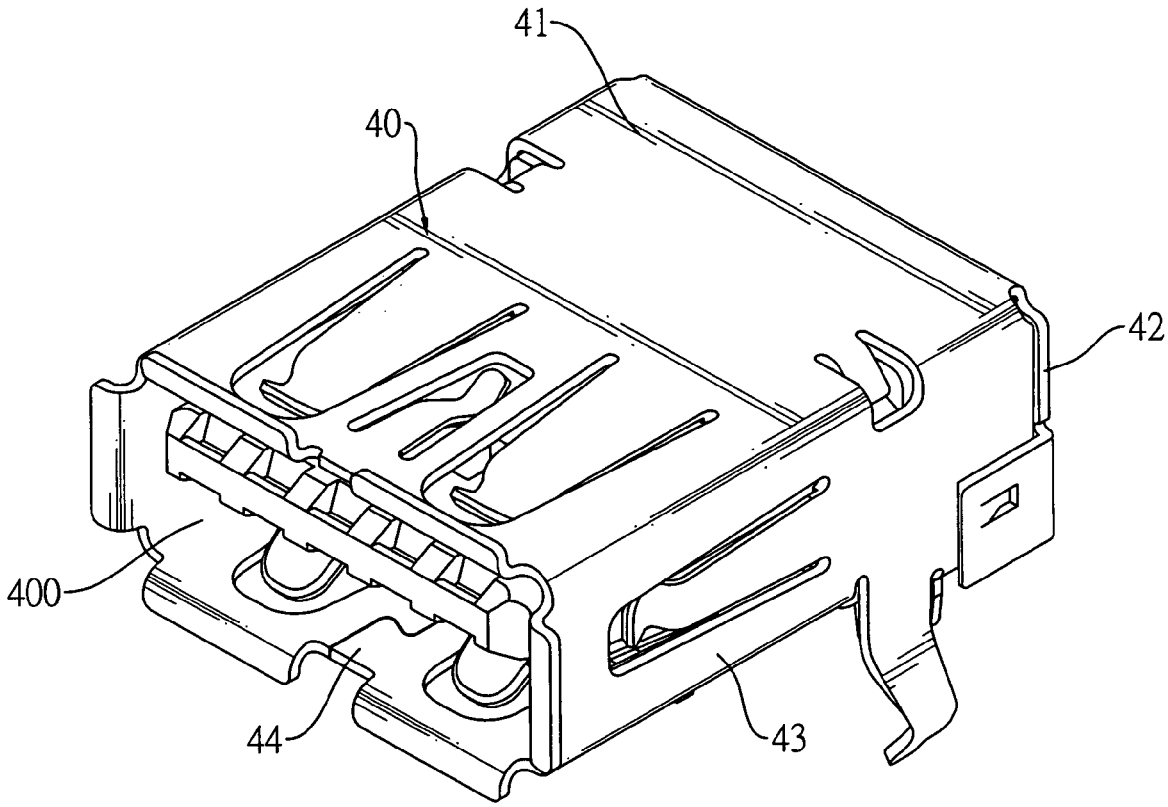
FIG. 1 is a top perspective view of a crosstalk-free connector in accordance with the present invention.
Figure 2:
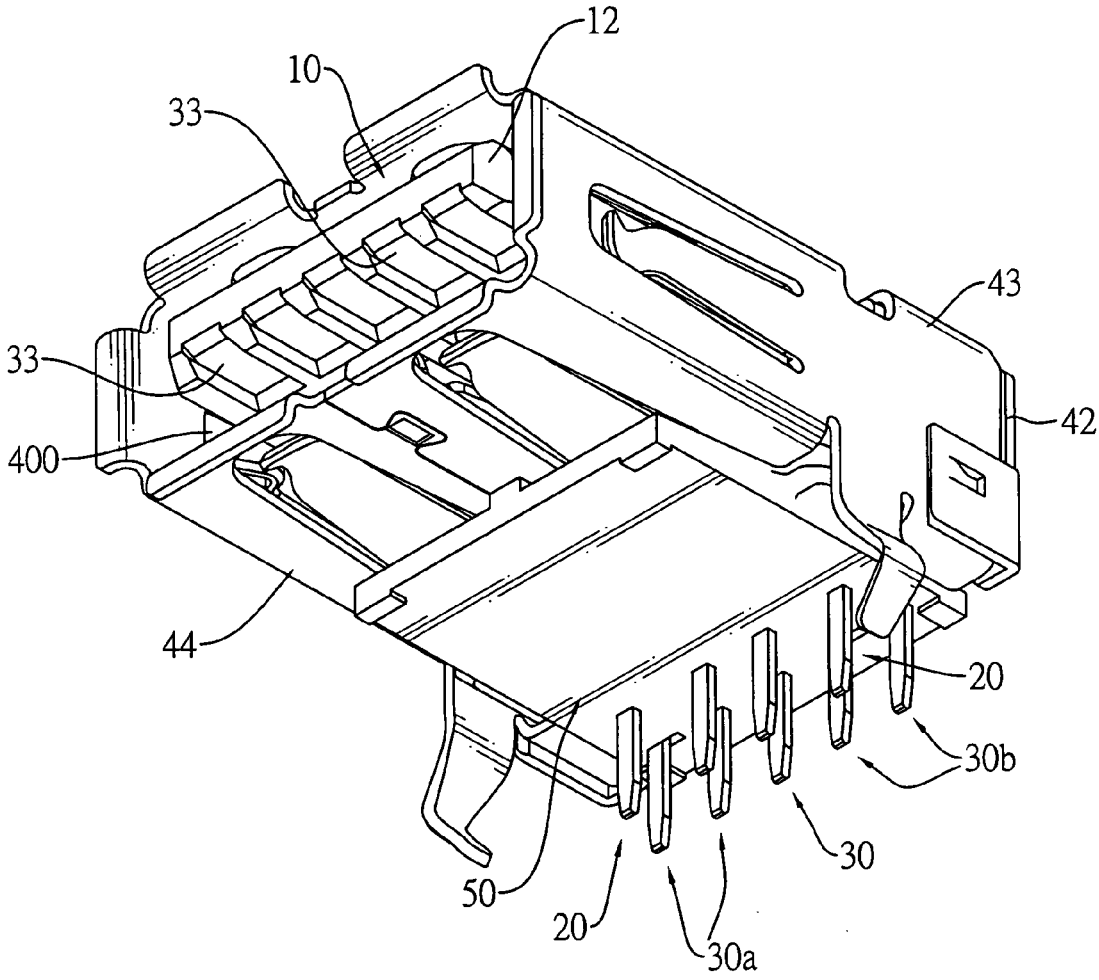
FIG. 2 is a bottom perspective view of the crosstalk-free connector in FIG. 1.
Figure 3:
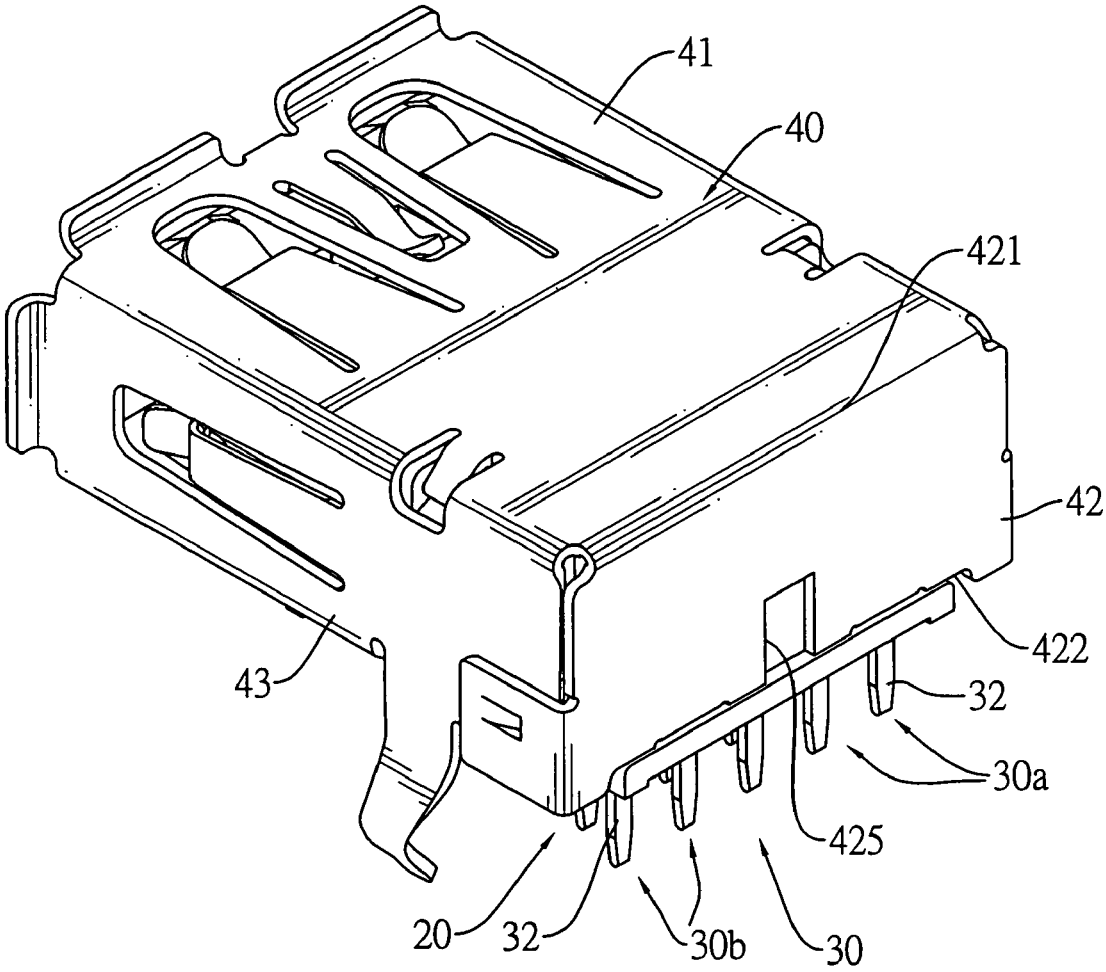
FIG. 3 is a rear perspective view of the crosstalk-free connector in FIG. 1.
Figure 4:
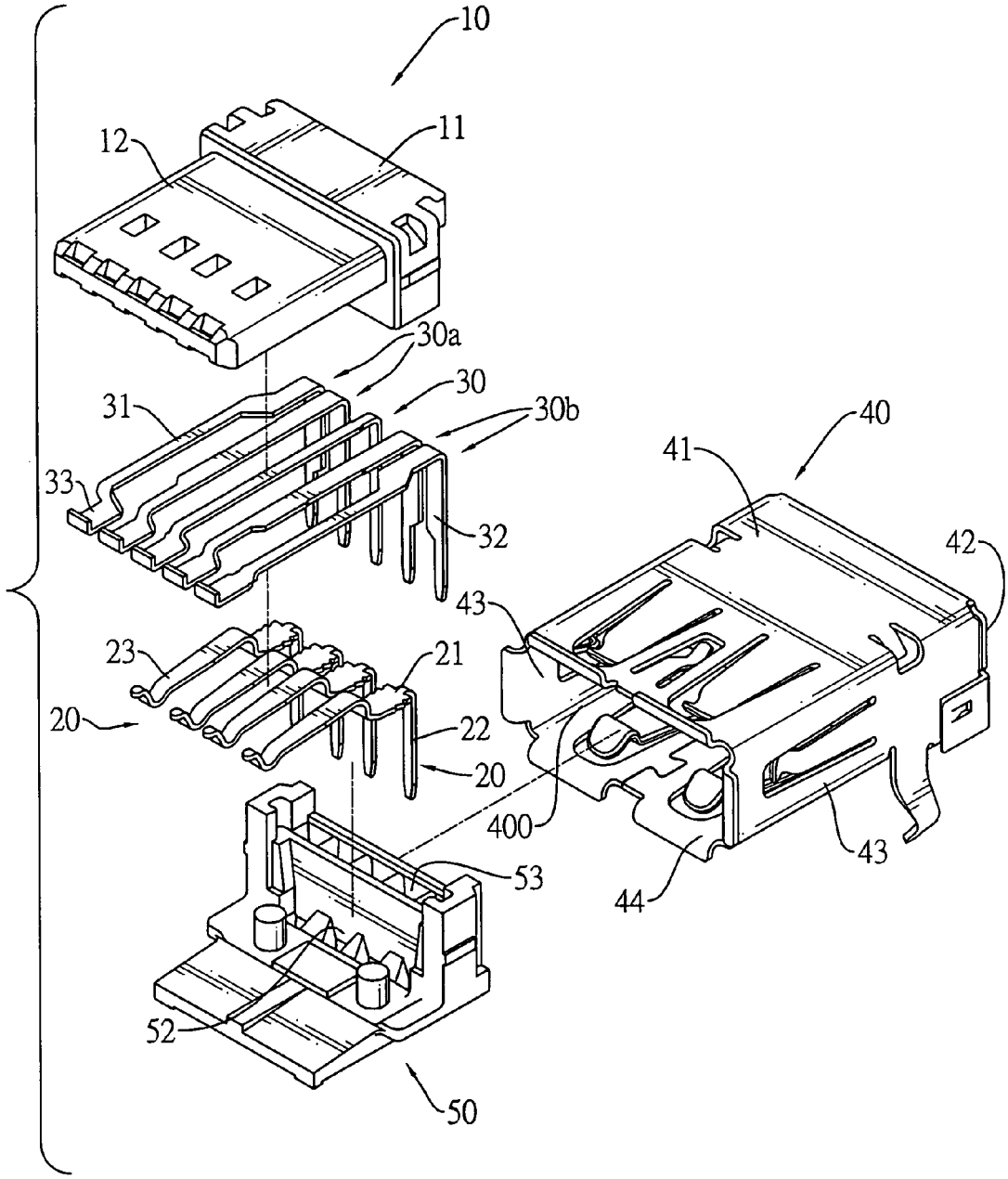
FIG. 4 is an exploded front perspective view of the crosstalk-free connector in FIG. 1.
Figure 5:
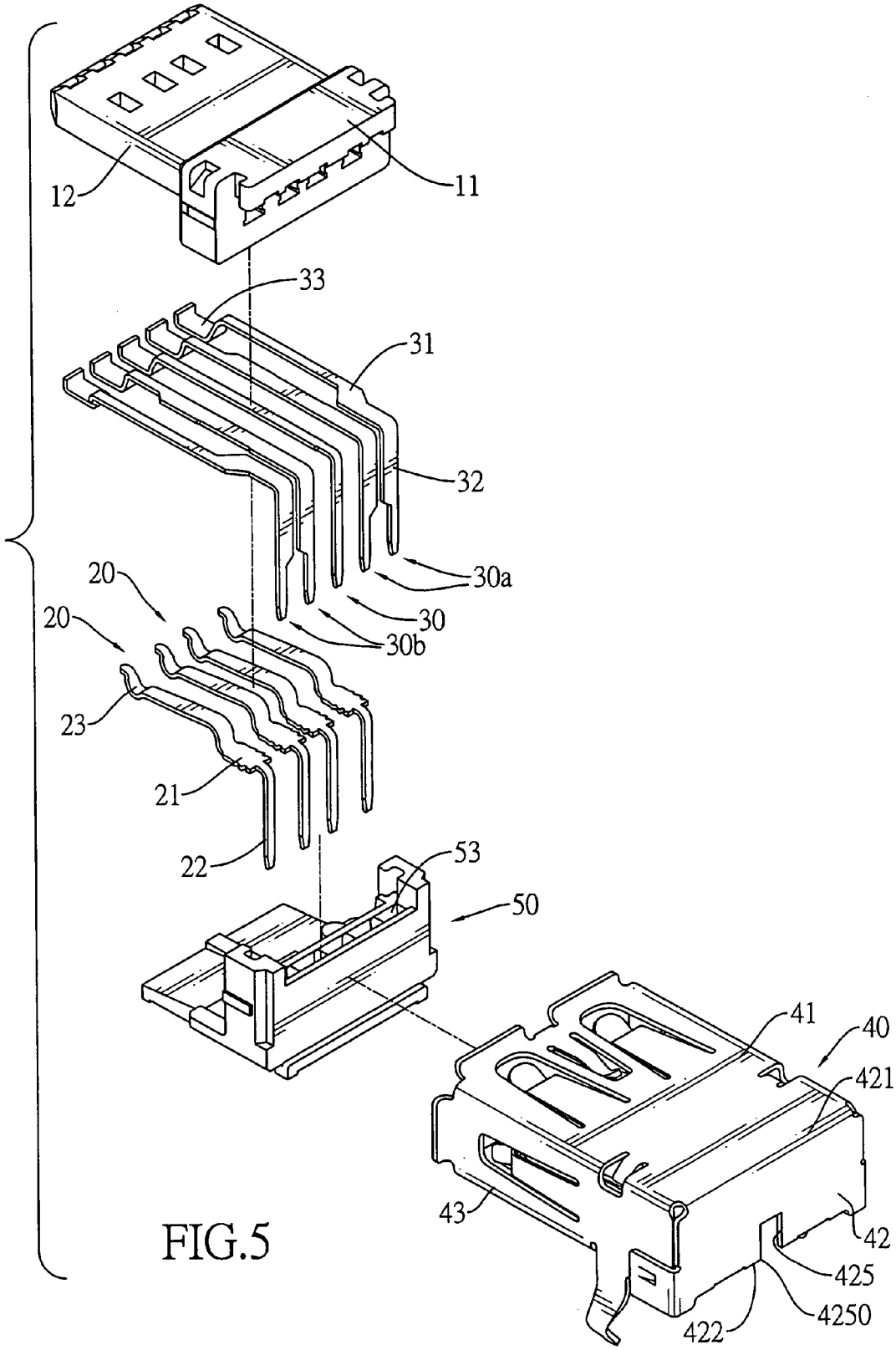
FIG. 5 is an exploded rear perspective view of the crosstalk-free connector in FIG. 3.
Figure 6:
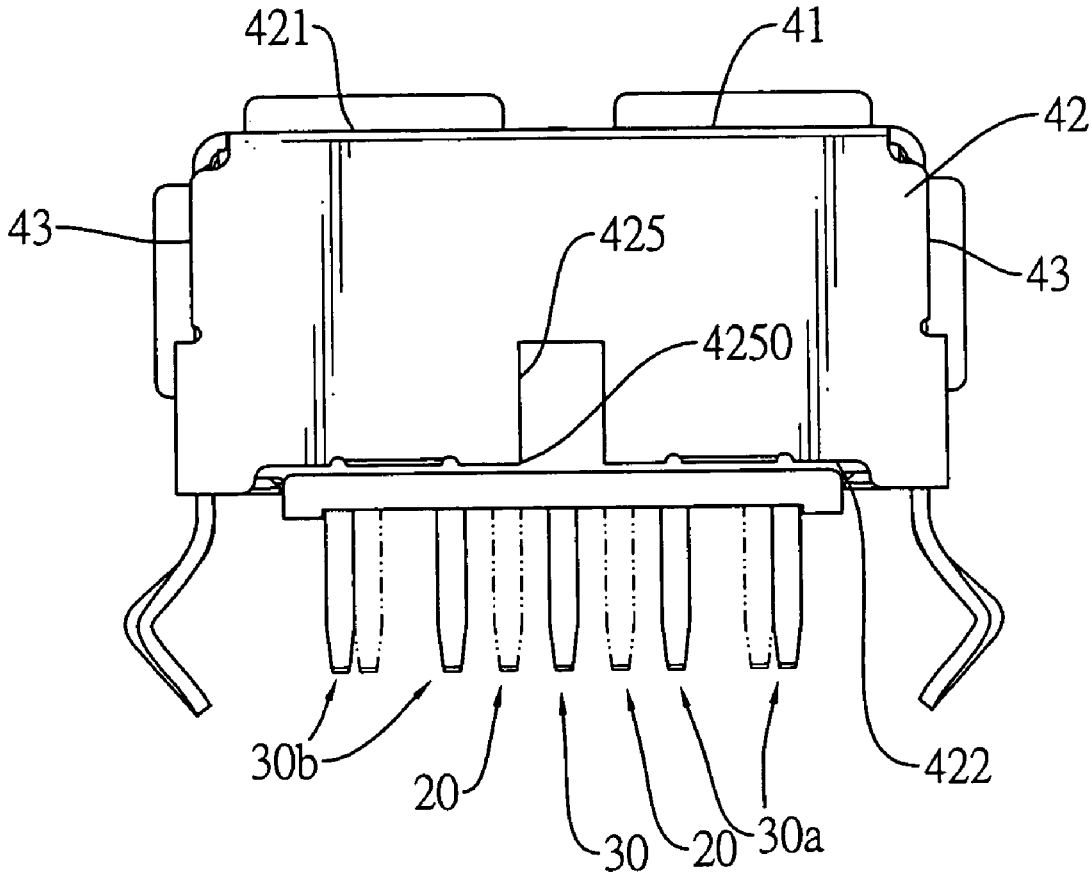
FIG. 6 is a rear view of the crosstalk-free connector in FIG. 1.

With further reference to FIG. 6, the top plate (41) has a front edge, a rear edge and two opposite side edges.

The rear plate (42) is formed on and protrudes substantially perpendicularly downwards from the rear edge of the top plate (41), behind rear end of the insulative body (10) and has a height, a top edge (421), a bottom edge (422) and at least one crosstalk-eliminating slot (425). The at least one crosstalk-eliminating slot (425) is defined through the rear plate (42) and each of the at least one crosstalk-eliminating slot (425) has a height and a width. When observed from the rear end of the insulative body, each of the at least one crosstalk-eliminating slot (425) is located between two adjacent pairs of the soldering sections (32) of two adjacent pairs of the signal transmission terminals.

In a preferred embodiment, a single crosstalk-eliminating slot (425) is implemented and is located between the soldering sections (32) of the pair of the first signal transmission terminals (30*a*) and the soldering sections (32) of the pair of the second signal transmission terminals (30*b*) of the USB 3.0 terminals (30, 30*a*, 30*b*).

Further, each of the at least one crosstalk-eliminating slot (425) may be an open slot having a bottom opening (4250) adjacent to the bottom edge of the rear plate (42). Moreover, the height of each of the at least one crosstalk-eliminating slot (425) may be equivalent to or smaller than that of the rear plate (42) and may be larger than the width of the crosstalk-eliminating slot (425). The side plates (43) are formed respectively on and protrude perpendicularly downwards from the side edges of the top plate (41) and each side plate (43) has a bottom edge.

The bottom plate (44) is formed between the bottom edges of the side plates (43).

The positioning bracket (50) is mounted under the insulative body (10) and has multiple positioning holes (52, 53). The positioning holes (52, 53) are defined through the positioning bracket (50) and are mounted respectively around the soldering sections (22, 32) of the terminals.

Figure 9:
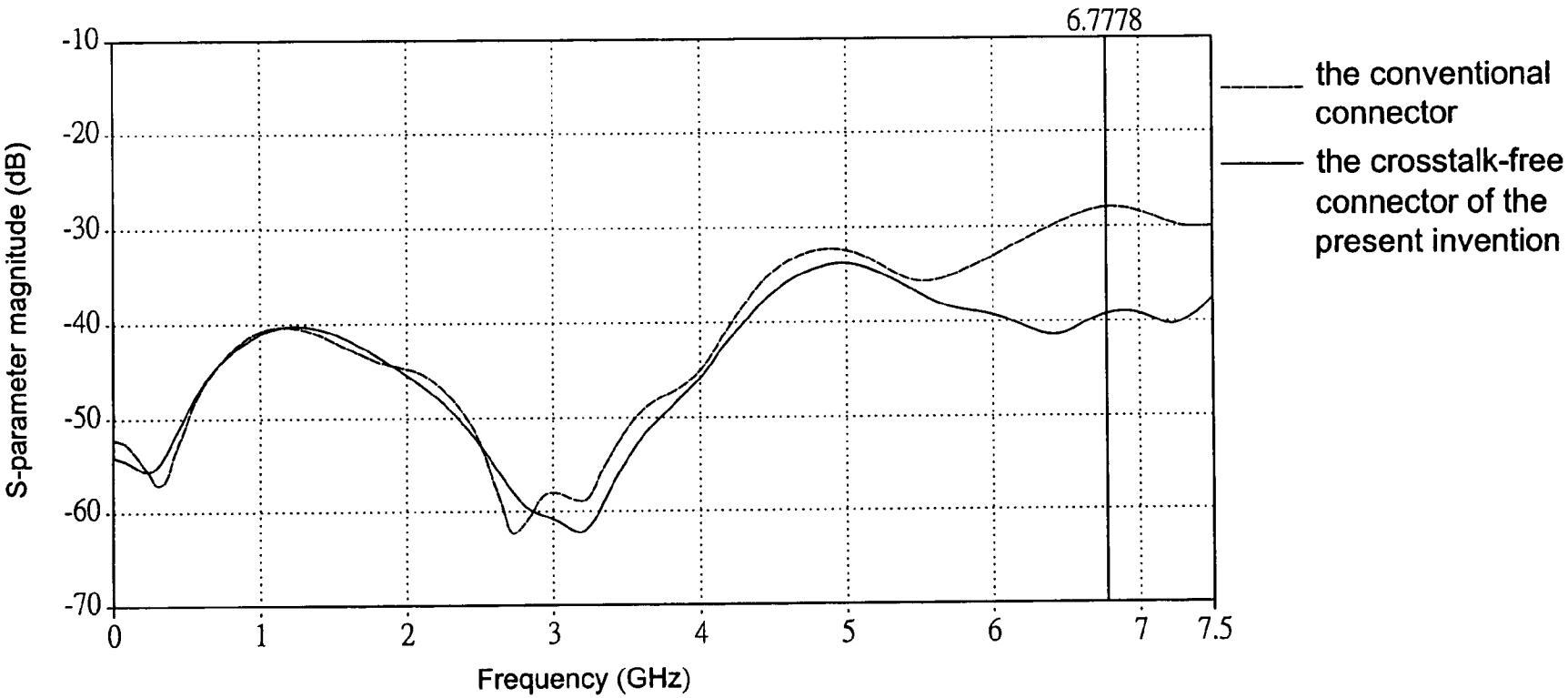
FIG. 9 is a curve diagram of scattering-parameter magnitude vs. frequency of the crosstalk-free connector in FIG. 1 and a conventional connector in accordance with prior art without crosstalk-eliminating slot.

With further reference to FIG. 9, a curve diagram of scattering-parameter (S-parameter) magnitude vs. frequency shows two curves respectively indicates the crosstalk-free connector of the present invention and a conventional connector in accordance with prior art without the crosstalk-eliminating slot. The unit of S-parameter magnitude is "dB" and the unit of the frequency is "GHz." A standard USB 3.0 connector qualified by the USB IF has the S-parameter magnitude being lower than −32 dB when the frequency is 0-2.5 GHz and has the S-parameter magnitude being lower than −25 dB when the frequency is 5-7 GHz. As indicated by the curves, when signal transmission is implemented, the crosstalk-free connector of the present invention has lower dB values than the conventional connector, especially in the high frequency range of 5-7 GHz. Therefore, the crosstalk-connector of the present invention has stronger S-parameter magnitude. Furthermore, the value of S-parameter magnitude of the conventional vibrates up and down more violently than the crosstalk-free connector of the present invention. Therefore, the crosstalk-free connector of the present invention efficiently eliminates the crosstalk between adjacent pairs of the signal transmission terminals, improves the stability of the S-parameter magnitude and advantages the high frequency signal transmission.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crosstalk-free connector comprising:

an insulative body having a front end and a rear end;

multiple terminals mounted in the insulative body and some of the terminals being multiple pairs of signal transmission terminals; and a metal shell covering the insulative body and the terminals and having a front opening;

a cavity defined in the metal shell, communicating with the front opening and accommodating the insulative body and the terminals; and a rear plate being behind the rear end of the insulative body and having at least one crosstalk-eliminating slot defined through the rear plate, and the at least one crosstalk-eliminating slot being located between two adjacent pairs of the signal transmission terminals when observed from the rear end of the insulative body;

wherein the rear plate of the metal shell has a top edge and a bottom edge, and the at least one crosstalk-eliminating slot is an open slot and has a bottom opening adjacent to the bottom edge of the rear plate; and wherein a height of the at least one crosstalk-eliminating slot is at most equivalent to a height of the rear plate.

2. The crosstalk-free connector as claimed in claim 1, wherein each terminal has a mounting section mounted in the insulative body;

a soldering section formed on and protruding downwards from the mounting section behind the insulative body; and a contacting section formed on and protruding forwards and exposed out of the insulative body; and the at least one crosstalk-eliminating slot is located between two adjacent pairs of the soldering sections of the two adjacent pairs of the signal transmission terminals when observed from the rear end of the insulative body.

3. The crosstalk-free connector as claimed in claim 1, wherein the height of the at least one crosstalk-eliminating slot is larger than a width of the crosstalk-eliminating slot.

4. The crosstalk-free connector as claimed in claim 2, wherein the terminals are classified into multiple USB 2.0 terminals and USB 3.0 terminals, and four of the USB 3.0 terminals are a pair of first signal transmission terminals and a pair of second signal transmission terminals; and the at least one crosstalk-eliminating slot is located between the soldering sections of the pair of the first signal transmission terminals and the soldering sections of the pair of the second signal transmission terminals.

5. The crosstalk-free connector as claimed in claim 4, wherein the insulative body has a base;

a tongue formed on and protruding forwards from the base;

multiple first terminals holes defined through the base and respectively holding the first signal transmission terminals;

multiple second terminal holes defined through the base and the tongue and respectively holding the second signal transmission terminals.

6. The crosstalk-free connector as claimed in claim 2 further comprising a positioning bracket mounted under the insulative body and having multiple positioning holes defined through the positioning bracket and mounted respectively around the soldering sections of the terminals.

7. The crosstalk-free connector as claimed in claim 1, wherein the metal shell further has a top plate, two opposite side plate and a bottom plate;

the top plate has a front edge, a rear edge and two opposite side edges;

the rear plate is formed on and protrudes downwards from the rear edge of the top plate;

the side plates are formed respectively on and protrude downwards from the side edges of the top plate and each side plate has a bottom edge; and the bottom plate is formed between the bottom edges of the side plates.

8. A crosstalk-free connector comprising:

an insulative body having a front end and a rear end;

multiple terminals mounted in the insulative body and some of the terminals being multiple pairs of signal transmission terminals; and a metal shell covering the insulative body and the terminals and having a front opening;

a cavity defined in the metal shell, communicating with the front opening and accommodating the insulative body and the terminals; and a rear plate being behind the rear end of the insulative body and having at least one crosstalk-eliminating slot defined through the rear plate, and the at least one crosstalk-eliminating slot being located between two adjacent pairs of the signal transmission terminals when observed from the rear end of the insulative body; wherein the rear plate has a top edge and a bottom edge, the at least one crosstalk-eliminating slot is an open slot and has a bottom opening adjacent to the bottom edge of the rear plate;

a height of the crosstalk of the at least one crosstalk-eliminating slot is at most equivalent to a height of the rear plate;

the height of the at least one crosstalk-eliminating slot is larger than a width of the crosstalk-eliminating slot; and the two adjacent pairs of the signal transmission terminals are a pair of transmitter differential terminals and a pair of receiver differential terminals and one of the at least one crosstalk-eliminating slot is located between the pairs of the transmitter and receiver differential terminals when observed from the rear end of the insulative body.

* * * * *